US007810477B2

(12) United States Patent
Knauf et al.

(10) Patent No.: US 7,810,477 B2
(45) **Date of Patent: *Oct. 12, 2010**

(54) OIL MIST REMOVAL DEVICE WITH OIL FILL

(75) Inventors: Craig R. Knauf, Wisconsin Rapids, WI (US); Chirag D. Parikh, Madison, WI (US); Mark V. Holzmann, Stoughton, WI (US); Christopher E. Holm, Madison, WI (US)

(73) Assignee: Cummins Filtration IP, Inc., Minneapolis, MN (US)

( * ) Notice: Subject to any disclaimer, the term of this patent is extended or adjusted under 35 U.S.C. 154(b) by 196 days.

This patent is subject to a terminal disclaimer.

(21) Appl. No.: 12/177,471

(22) Filed: Jul. 22, 2008

(65) Prior Publication Data

US 2008/0276580 A1 Nov. 13, 2008

Related U.S. Application Data

(62) Division of application No. 11/256,538, filed on Oct. 21, 2005, now Pat. No. 7,406,960.

(60) Provisional application No. 60/635,364, filed on Dec. 10, 2004.

(51) Int. Cl.
*F16N 21/00* (2006.01)

(52) U.S. Cl. ..... 123/572; 123/41.86

(58) Field of Classification Search ..... 123/572–574, 123/41.86; 55/385.4, 338, 33; 44/340, 462
See application file for complete search history.

(56) References Cited

U.S. PATENT DOCUMENTS

| | | | |
|---|---|---|---|
| 1,548,288 | A | 8/1925 | Smith |
| 1,761,944 | A | 6/1930 | Smith |
| 2,493,617 | A | 1/1950 | Chubbuck |
| 3,201,925 | A | 8/1965 | Shada |
| 3,433,231 | A | 3/1969 | Siragusa |
| 3,923,480 | A | 12/1975 | Visch |
| 4,012,209 | A | 3/1977 | McDowell et al. |
| 4,014,673 | A | 3/1977 | Kinnison |
| 4,401,093 | A | 8/1983 | Gates, Jr. et al. |
| 4,993,517 | A | 2/1991 | Leipelt et al. |
| 5,129,371 | A | 7/1992 | Rosalik, Jr. |
| 5,201,301 | A | 4/1993 | Re |
| 5,205,848 | A | 4/1993 | Blanc et al. |

(Continued)

FOREIGN PATENT DOCUMENTS

| | | |
|---|---|---|
| CH | 127029 | 5/1927 |

(Continued)

OTHER PUBLICATIONS

Highly Efficient Oil Separation Systems for Minimised Oil Carry Over, MTZ Apr. 2008, vol. 69, pp. 32-37.

*Primary Examiner*—M. McMahon
(74) *Attorney, Agent, or Firm*—Andrus, Sceales, Starke & Sawall, LLP; J. Bruce Schelkopf

(57) ABSTRACT

An oil mist removal device, with oil fill, is provided for an internal combustion engine. A housing has first and second passages, and a separator therebetween. An oil fill port in the first passage is provided for adding oil to the engine.

6 Claims, 4 Drawing Sheets

U.S. PATENT DOCUMENTS

| | | | | |
|---|---|---|---|---|
| 5,329,913 | A | 7/1994 | Suzuki et al. | |
| 5,460,147 | A | 10/1995 | Bohl | |
| 5,562,087 | A | 10/1996 | Wright | |
| 5,564,401 | A | 10/1996 | Dickson | |
| 6,073,618 | A | 6/2000 | Sanders et al. | |
| 6,074,448 | A | 6/2000 | Schulz et al. | |
| 6,152,120 | A | 11/2000 | Julazadeh | |
| 6,247,463 | B1 | 6/2001 | Fedorowicz et al. | |
| 6,279,556 | B1 | 8/2001 | Busen et al. | |
| 6,290,738 | B1 | 9/2001 | Holm | |
| 6,293,268 | B1 | 9/2001 | Mammarella | |
| 6,354,283 | B1 | 3/2002 | Hawkins et al. | |
| 6,402,798 | B1 | 6/2002 | Kallsen et al. | |
| 6,418,918 | B2 | 7/2002 | Mammarella | |
| 6,435,170 | B1 * | 8/2002 | Hamelink et al. | 123/572 |
| 6,478,018 | B2 | 11/2002 | Fedorowicz et al. | |
| 6,478,019 | B2 | 11/2002 | Fedorowicz et al. | |
| 6,505,615 | B2 | 1/2003 | Pietschner | |
| 6,533,712 | B1 | 3/2003 | Miller et al. | |
| 6,568,540 | B1 | 5/2003 | Holzmann et al. | |
| 6,576,045 | B2 | 6/2003 | Liu et al. | |
| 6,601,385 | B2 | 8/2003 | Verdegan et al. | |
| 6,626,163 | B1 | 9/2003 | Busen et al. | |
| 6,684,864 | B1 | 2/2004 | Busen et al. | |
| 6,797,040 | B2 | 9/2004 | Lenzing | |
| 6,973,925 | B2 | 12/2005 | Sauter et al. | |
| 7,080,636 | B2 | 7/2006 | Knaus et al. | |
| 7,152,589 | B2 | 12/2006 | Ekeroth et al. | |
| 7,156,901 | B2 | 1/2007 | Hallgren et al. | |
| 7,185,643 | B2 | 3/2007 | Gronberg et al. | |
| 7,238,216 | B2 | 7/2007 | Malgorn | |
| 7,258,111 | B2 * | 8/2007 | Shieh et al. | 123/572 |
| 7,406,960 | B2 | 8/2008 | Knauf et al. | |
| 7,678,169 | B1 * | 3/2010 | Gwin et al. | 55/385.4 |
| 2005/0000572 | A1 | 1/2005 | Muller | |
| 2006/0059875 | A1 | 3/2006 | Malgorn et al. | |
| 2006/0062699 | A1 | 3/2006 | Evenstad et al. | |
| 2006/0081229 | A1 | 4/2006 | Gronberg | |
| 2006/0249128 | A1 | 11/2006 | Shieh et al. | |
| 2007/0062887 | A1 | 3/2007 | Schwandt et al. | |
| 2007/0256566 | A1 | 11/2007 | Faber et al. | |

FOREIGN PATENT DOCUMENTS

| | | |
|---|---|---|
| DE | 1544126 | 6/1969 |
| DE | 10051307 | 5/2002 |
| DE | 10320215 | 12/2004 |
| DE | 102005042286 | 4/2007 |
| EP | 0754840 | 1/1997 |
| EP | 1068890 | 1/2001 |
| EP | 1477641 | 11/2004 |
| FR | 1406047 | 7/1965 |
| FR | 2835764 | 8/2003 |
| FR | 2852056 | 9/2004 |
| WO | WO-2006/119737 | 11/2006 |
| WO | WO-2007/028351 | 3/2007 |
| WO | WO-2007/137934 | 12/2007 |
| WO | WO-2007/138008 | 12/2007 |

* cited by examiner

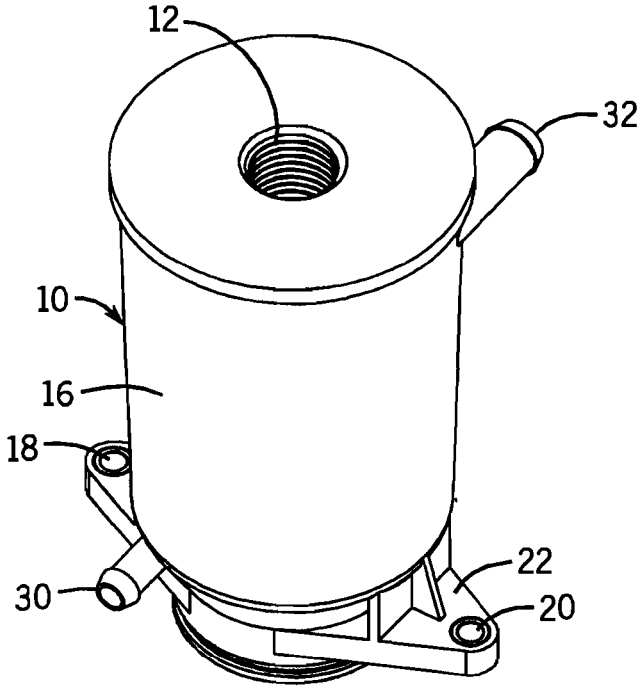
FIG. 1
FIG. 2
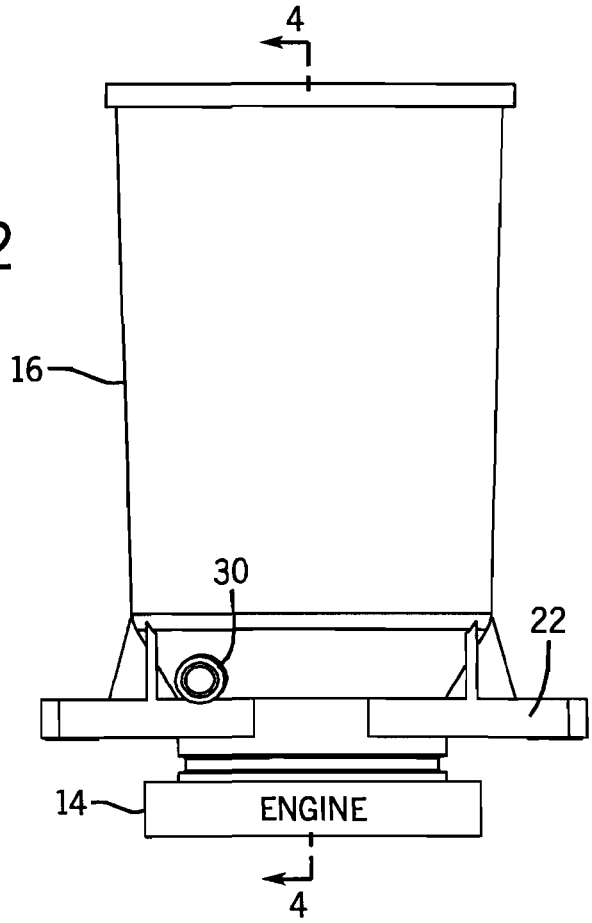

FIG. 5
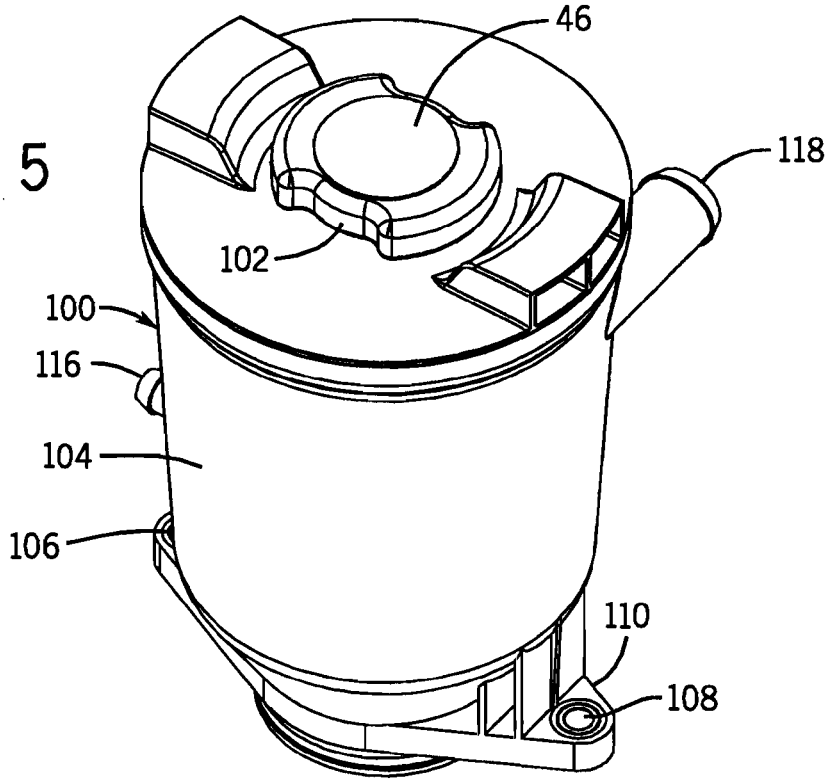
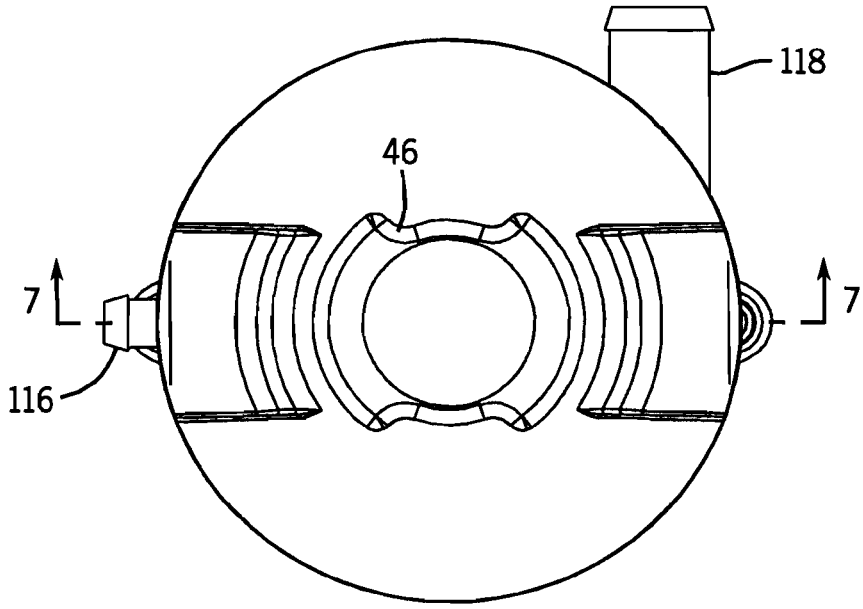
FIG. 6

OIL MIST REMOVAL DEVICE WITH OIL FILL

CROSS-REFERENCE TO RELATED APPLICATIONS

This application is a division of U.S. patent application Ser. No. 11/256,538, filed Oct. 21, 2005 now U.S. Pat. No. 7,406,960, which claims the benefit of and priority from provisional U.S. Patent Application No. 60/635,364, filed Dec. 10, 2004.

BACKGROUND AND SUMMARY

The invention relates to oil mist removal devices for an internal combustion engine.

The invention provides an oil mist removal device, with oil fill, for an internal combustion engine. The invention arose during development efforts directed toward providing a breather system that can remove oil from gases that are vented from the engine. Two embodiments are provided, each of which in preferred form is bolted to the engine valve cover, though the invention is not limited thereto. One embodiment uses impactor technology, and the other uses coalescing filter technology. Both designs incorporate an oil fill.

BRIEF DESCRIPTION OF THE DRAWING

FIG. 1 is a perspective view of an oil mist removal device in accordance with the invention.

FIG. 2 is a side elevation view of the device of FIG. 1.

FIG. 5 is a perspective view of another embodiment of an oil mist removal device in accordance with the invention.

FIG. 6 is a top elevation view of the device of FIG. 5.

DETAILED DESCRIPTION

Figure 3:
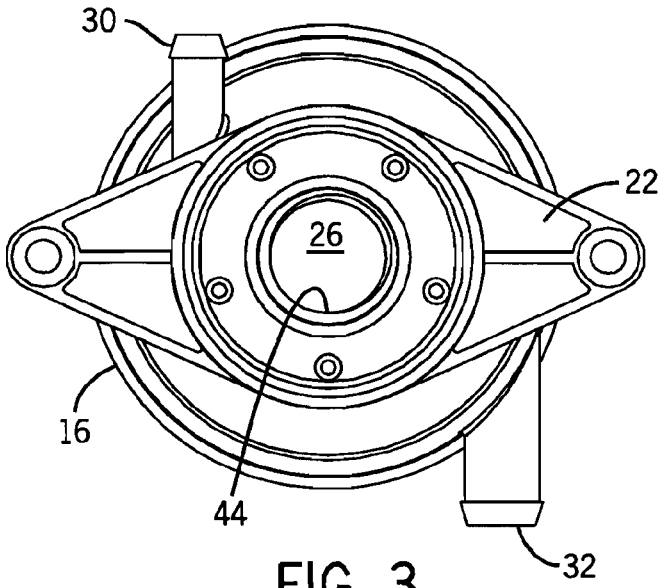
FIG. 3 is a bottom elevation view of the device of FIG. 2.
Figure 4:
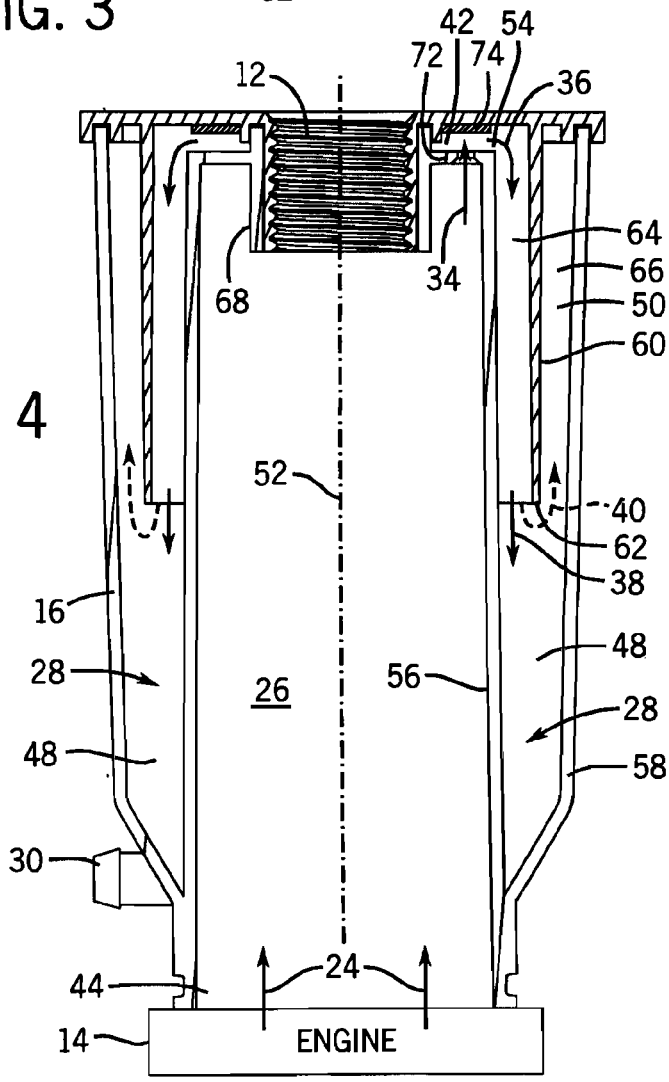
FIG. 4 is a sectional view taken along line 4-4 of FIG. 2.

FIG. 1 shows an oil mist removal device 10, with integral oil fill 12, for an internal combustion engine, schematically shown at 14, FIGS. 2, 4. Device 10 includes a housing 16 mounted to engine 14, for example bolted to the engine valve cover through bolt holes such as 18, 20 through housing bushing or flange 22. Housing 16 receives oil mist from the engine, as shown at arrows 24, FIG. 4. The housing has a first passage 26 extending upwardly from the engine for receiving the oil mist. The housing has a second passage 28 having an oil drain outlet 30 draining oil therefrom, and a gas outlet 32 discharging gas therefrom. The housing has a flow path therethrough from engine 14 then through first passage 26 as shown at arrows 24, 34, then through second passage 28 as shown at arrows 36, 38, 40. A separator 42 is provided in the housing along the noted flow path between the first and second passages and separates the oil mist into separated oil, e.g. 38, and gas, e.g. 40. An oil fill port 12 in first passage 26 is provided for adding oil to the engine.

First passage 26 has a lower inlet 44 receiving oil mist 24 from engine 14, and has an upper port at 12 providing the noted oil fill port. An oil fill cap (not shown in FIGS. 1-4, but shown at 46 in FIGS. 5-7) is removably mounted to the housing in sealing relation at oil fill port 12, e.g. preferably in threaded relation. Oil fill cap 46 has a first condition mounted to the housing in sealing relation at oil fill port 12 and blocking flow of oil mist 24 therepast from first passage 26. Oil fill cap 46 has a second condition removed from the housing and permitting oil to be introduced through the then open oil fill port 12 to flow through first passage 26 and through lower inlet port 44 to be added to engine 14.

Second passage 28 has a first lower portion 48 passing separated oil downwardly to oil drain outlet 30, and has a second portion 50 passing separated gas upwardly to gas outlet 32. Second passage 28 circumscribes first passage 26. Housing 16 extends along an axis 52. First passage 26 extends axially upwardly from oil mist inlet 44 to oil fill port 12. First portion 48 of second passage 28 extends axially downwardly to oil drain outlet 30. Second portion 50 of second passage 28 extends axially upwardly to gas outlet 32. First and second passages 26 and 28 are laterally offset from each other relative to axis 52. The noted flow path extends laterally as shown at 54 between first and second passages 26 and 28.

Housing 16 has a first wall 56 extending axially along and defining first and second passages 26 and 28 on opposite lateral sides thereof. Housing 16 has a second wall 58 laterally spaced from first wall 56 and defining second passage 28 therebetween. Housing 16 has a baffle 60 laterally spaced between first and second walls 56 and 58 and extending axially downwardly in second passage 28 to a lower tip 62. Second passage 28 has a lower portion at 48 below lower tip 62, and has an upper portion at 50 above lower tip 62. Upper portion 50 has a first subportion 64 laterally between first wall 56 and baffle 60. Upper portion 50 has a second subportion 66 laterally between baffle 60 and second wall 58. Both separated oil and separated gas flow axially downwardly in first subportion 64 of upper portion 50 of second passage 28, as shown at arrow 36. Separated gas flows axially upwardly in second subportion 66 of upper portion 50 of second passage 28, as shown at arrow 40. Separated oil flows axially downwardly in lower portion 48 of second passage 28, as shown at arrow 38.

Housing 16 has a wall 68, FIG. 4, at the top of first passage 26 and defining a mounting seat at 12 mounting an oil fill cap such as 46. The housing may include a second baffle (not shown in FIGS. 1-4, but shown at 70 in FIG. 7, providing an inlet baffle at oil mist inlet 44 directing oil mist flow from engine 14 into first passage 26.

In the embodiment of FIGS. 1-4, separator 42 is an impactor comprising a plurality of circumferentially spaced nozzles, e.g. openings, accelerating oil mist flow therethrough from first passage 26 against an impaction separation plate 74. Nozzles 72 accelerate the oil mist flow axially upwardly therethrough against a laterally extending impaction separation plate 74 axially spaced thereabove, whereafter separated oil and gas flow laterally at 54 to second passage 28 as shown at arrow 36.

Figure 7:
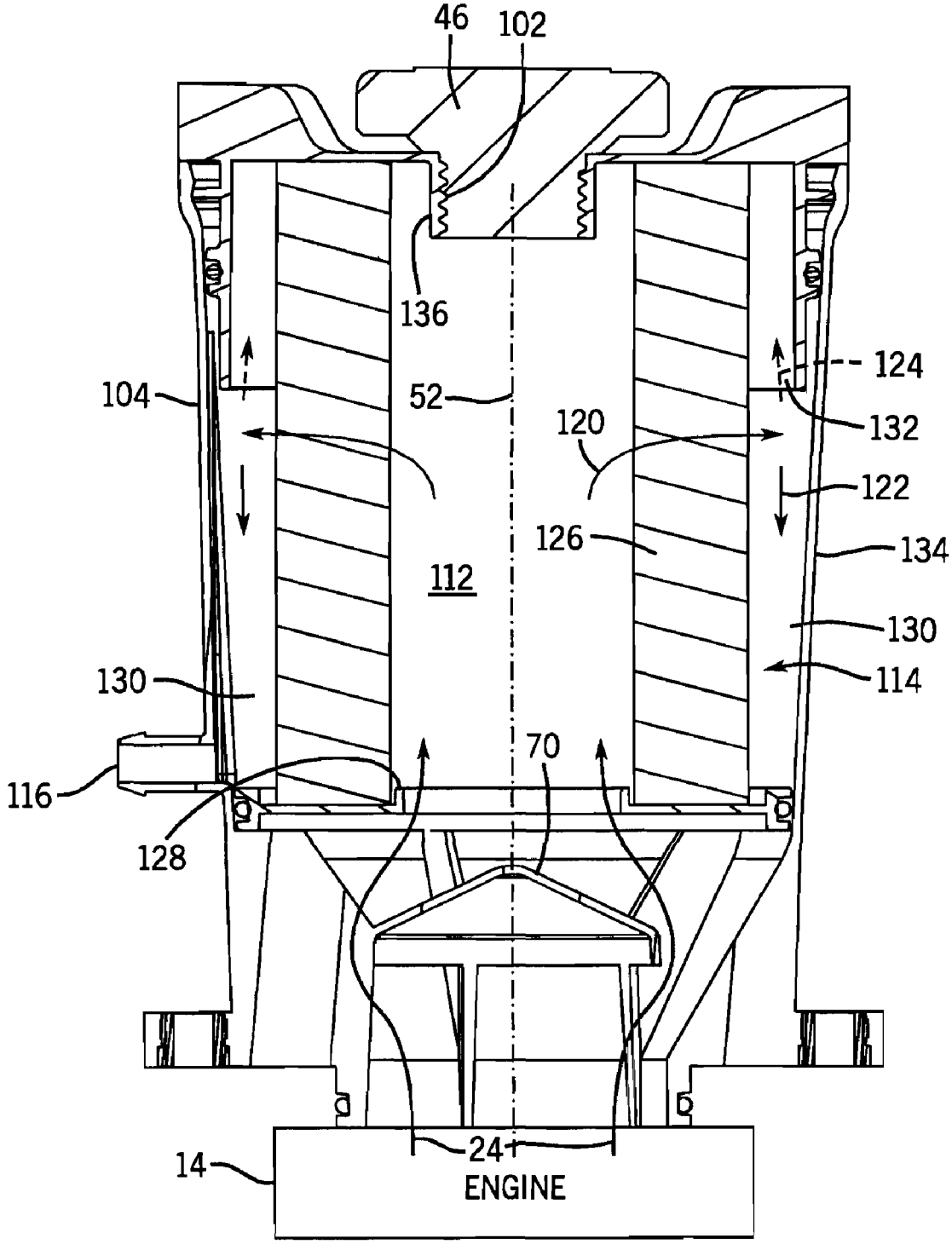
FIG. 7 is a sectional view taken along line 7-7 of FIG. 6.

FIGS. 5-7 show an alternate embodiment and use like reference numerals from above where appropriate to facilitate understanding. FIGS. 5-7 show an oil mist removal device 100, with integral oil fill 102, for internal combustion engine 14. The device includes a housing 104 mounted to engine 14, for example bolted to the engine valve cover at bolt holes 106, 108 through a mounting a flange or bushing 110. The housing receives oil mist from the engine as shown at 24. Housing 104 has a first passage 112 extending upwardly from the engine for receiving the oil mist at 24. The housing has a second passage 114 adjacent first passage 112. Second passage 114 has an oil drain outlet 116 draining oil therefrom, and has a gas outlet discharge 118 discharging gas therefrom. The housing has a flow path therethrough from engine 14 then through first passage 112 as shown at arrows 24, 120, then through second passage 114 as shown at arrows 122, 124. A separator 126 is provided in the housing along the noted flow path between first and second passages 112 and 114 and separates the oil mist into separated oil and gas as shown at arrows 122 and 124 respectively. An oil fill port is provided at 102 in first passage 112 for adding oil to the engine.

First passage 112, FIG. 7, has a lower inlet port 128 providing an oil mist inlet receiving oil mist at 24 from engine 14. First passage 112 has an upper port at 102 providing the noted oil fill port. Oil fill cap 46 is removably mounted to housing 104 in sealing relation at oil fill port 102, preferably by being threaded thereto. Oil fill cap 46 has a first condition mounted to housing 104 in sealing relation at oil fill port 102 and blocking flow of oil mist therepast from first passage 112. Oil fill cap 46 has a second condition removed from housing 104 and permitting oil to be introduced through the now open oil fill port 102 to flow through first passage 112 and through lower inlet port 128 to be added to the engine.

Second passage 114, FIG. 7, has a first portion 130 passing separated oil downwardly to oil drain outlet 116, as shown at arrow 122. Second passage 114 has a second portion 132 passing separated gas upwardly to gas outlet 118, as shown at arrow 124. Second passage 114 circumscribes first passage 112. Housing 104 extends along axis 52. First passage 112 extends axially upwardly from oil mist inlet 128 to oil fill port 102. First portion 130 of second passage 114 extends axially downwardly to oil drain outlet 116. Second portion 132 of second passage 114 extends axially upwardly to gas outlet 118. First and second passages 112 and 114 are laterally offset from each other relative to axis 52. The noted flow path extends laterally as shown at 120 between first and second passages 112 and 114.

In FIGS. 5-7, separator 126 is a coalescer filter extending axially along and defining first and second passages 112 and 114 on opposite lateral sides thereof. Housing 104 has a wall 134 laterally spaced from coalescer 126 and defining second passage 114 therebetween. Second passage 114 has the noted lower portion at 130 and the noted upper portion at 132. Separated oil flows axially downwardly in lower portion 130 of second passage 114. Separated gas flows axially upwardly in upper portion 132 of second passage 114.

Housing 104 has a mounting wall 136, FIG. 7, at the top of first passage 112 and defining a mounting seat mounting oil fill cap 46. An inlet baffle 70 is provided at oil mist inlet 128 directing oil mist flow at 24 from engine 14 into first passage 112.

It is recognized that various equivalents, alternatives and modifications are possible within the scope of the appended claims.

What is claimed is:

1. An oil mist removal device, with oil fill, for an internal combustion engine, comprising a housing mounted to said engine for receiving oil mist therefrom, said housing having a first passage extending upwardly from said engine for receiving said oil mist, said housing having a second passage adjacent said first passage, said second passage having an oil drain outlet for draining oil therefrom, said second passage having a gas outlet discharging gas therefrom, said housing having a flow path therethrough from said engine then through said first passage then through said second passage, a separator in said housing along said flow path between said first and second passages and separating said oil mist into separated oil and gas, an oil fill port in said first passage for adding oil to said engine, wherein said first passage has a lower inlet port providing an oil mist inlet receiving oil mist from said engine, and an upper port providing said oil fill port, and comprising an oil fill cap removably mounted to said housing in sealing relation at said oil fill port, said oil fill cap having a first condition mounted to said housing in said sealing relation at said oil fill port and blocking flow of oil mist therepast from said first passage, said oil fill cap having a second condition removed from said housing and permitting oil to be introduced through said oil fill port to flow through said first passage and through said lower inlet port to be added to said engine, said second passage has a first portion passing separated oil downwardly to said oil drain outlet, and a second portion passing separated gas upwardly to said gas outlet, said housing extends along an axis, said first passage extends axially upwardly from said oil mist inlet to said oil fill port, said first portion of said second passage extends axially downwardly to said oil drain outlet, said second portion of said second passage extends axially upwardly to said gas outlet, said first and second passages are laterally offset from each other relative to said axis, and said flow path extends laterally between said first and second passages, said housing has a first wall extending axially along and defining said first and second passages on opposite lateral sides thereof, said housing has a second wall laterally spaced from said first wall and defining said second passage therebetween.

2. The oil mist removal device according to claim 1 wherein said housing has a baffle laterally spaced between said first and second walls and extending axially downwardly in said second passage to a lower tip, said second passage having a lower portion below said lower tip, and an upper portion above said lower tip, said upper portion having a first subportion laterally between said first wall and said baffle, said upper portion having a second subportion laterally between said baffle and said second wall, wherein both separated oil and separated gas flow axially downwardly in said first subportion of said upper portion of said second passage, separated gas flows axially upwardly in said second subportion of said upper portion of said second passage, and separated oil flows axially downwardly in said lower portion of said second passage.

3. The oil mist removal device according to claim 2 wherein said housing has a third wall at the top of said first passage and defining a mounting seat mounting said oil fill cap.

4. The oil mist removal device according to claim 2 comprising a second baffle at said oil mist inlet directing oil mist flow from said engine into said first passage.

5. The oil mist removal device according to claim 2 wherein said separator comprises an impactor comprising a plurality of nozzles accelerating oil mist flow therethrough from said first passage against an impaction separation plate.

6. The oil mist removal device according to claim 5 wherein said nozzles accelerate said oil mist flow axially upwardly therethrough against a laterally extending said impaction separation plate spaced axially thereabove, whereafter separated oil and gas flow laterally to said second passage.

* * * * *